US010711509B2

(12) United States Patent
Shi et al.

(10) Patent No.: US 10,711,509 B2
(45) Date of Patent: Jul. 14, 2020

(54) DOUBLE SLIDING-PLUG DOOR SYSTEM

(71) Applicant: NANJING KANGNI MECHANICAL & ELECTRICAL CO., LTD., Nanjing, Jiangsu (CN)

(72) Inventors: Xiang Shi, Jiangsu (CN); Zuxin Dai, Jiangsu (CN); Hanqing Ge, Jiangsu (CN); Xudong Shi, Jiangsu (CN); Wenkai Zu, Jiangsu (CN)

(73) Assignee: NANJING KANGNI MECHANICAL & ELECTRICAL CO., LTD., Nanjing, Jiangsu (CN)

( * ) Notice: Subject to any disclaimer, the term of this patent is extended or adjusted under 35 U.S.C. 154(b) by 133 days.

(21) Appl. No.: 16/071,607

(22) PCT Filed: Jan. 28, 2016

(86) PCT No.: PCT/CN2016/072482

§ 371 (c)(1),
(2) Date: Jul. 20, 2018

(87) PCT Pub. No.: WO2017/124580

PCT Pub. Date: Jul. 27, 2017

(65) Prior Publication Data

US 2019/0024440 A1 Jan. 24, 2019

(30) Foreign Application Priority Data

Jan. 22, 2016 (CN) ..... 2016 1 0046795

(51) Int. Cl.
*E05C 7/06* (2006.01)
*E06B 3/46* (2006.01)
(Continued)

(52) U.S. Cl.
CPC ..... *E06B 3/4636* (2013.01); *E05B 81/06* (2013.01); *E05B 81/90* (2013.01); *E05B 83/40* (2013.01);
(Continued)

(58) Field of Classification Search
CPC .... E06B 3/4636; E06B 3/4609; E06B 3/4654; E06B 3/487; E05F 15/652; E05F 11/54;
(Continued)

(56) References Cited

U.S. PATENT DOCUMENTS 4,091,570 A * 5/1978 Favrel ..... E05D 15/1044 49/118
4,198,786 A * 4/1980 Monot ..... B61D 19/02 49/362
(Continued)

OTHER PUBLICATIONS

Written Opinion and International Search Report of PCT/CN2016/072482, dated Oct. 31, 2016, 10 pages (English and Chinese).

*Primary Examiner* — Jerry E Redman
(74) *Attorney, Agent, or Firm* — Rankin, Hill & Clark LLP

(57) ABSTRACT

A double sliding-plug door system includes a fixed frame, a sliding-plug rail arranged in the fixed frame, a cross beam, a driving mechanism, a linkage mechanism, a guide locking piece and a limiting mechanism. The driving mechanism has a screw rod and a motor driven nut assembly having a transmission frame, a nut sleeved in the screw rod and a follow-up member fixed in the nut; the nut mounted in the transmission frame, which itself is connected with an active sleeve assembly; the screw rod drives the nut assembly to reciprocate axially along the screw rod.

27 Claims, 8 Drawing Sheets

(51) Int. Cl.

| | |
|---|---|
| ***E05F 15/652*** | (2015.01) |
| ***E05B 81/06*** | (2014.01) |
| ***E05B 81/90*** | (2014.01) |
| ***E05B 83/40*** | (2014.01) |
| ***E05D 15/06*** | (2006.01) |
| *E05F 11/54* | (2006.01) |

(52) U.S. Cl.
CPC ..... *E05D 15/063* (2013.01); *E05F 15/652* (2015.01); *E06B 3/46* (2013.01); *E05F 11/54* (2013.01); *E05Y 2201/22* (2013.01); *E05Y 2201/232* (2013.01); *E05Y 2201/654* (2013.01); *E05Y 2201/662* (2013.01); *E05Y 2201/676* (2013.01); *E05Y 2900/51* (2013.01); *E05Y 2900/531* (2013.01)

(58) Field of Classification Search
CPC ..... E05B 83/40; E05B 81/06; E05B 81/40; E05Y 2900/531; E05Y 2900/51
USPC ..... 49/116, 118
See application file for complete search history.

(56) References Cited

U.S. PATENT DOCUMENTS 5,077,938 A * 1/1992 Moreuil ..... E05F 15/652 49/362
5,341,598 A * 8/1994 Reddy ..... B61D 19/02 49/362
5,483,769 A * 1/1996 Zweili ..... B61D 19/008 49/118
5,893,236 A * 4/1999 Krbec ..... B61D 19/008 49/118
5,927,015 A * 7/1999 Ghosn ..... E05B 65/0823 49/291
6,009,668 A * 1/2000 Reddy ..... E05C 3/34 49/280
6,189,265 B1 * 2/2001 Fink ..... E05D 15/1044 49/118
7,971,391 B2 * 7/2011 Harie ..... E05F 17/004 49/120
8,136,299 B2 * 3/2012 Inage ..... B61D 19/005 49/118
8,661,733 B2 * 3/2014 Lee ..... E05B 47/0012 49/116
8,978,301 B2 * 3/2015 Ueda ..... E05B 83/363 49/122
9,702,178 B2 * 7/2017 Takayama ..... E05F 15/632
10,119,319 B2 * 11/2018 Ritt ..... B61D 19/02
10,494,852 B2 * 12/2019 Fujita ..... E05F 15/635
2002/0194783 A1 * 12/2002 Stojc ..... F16H 25/24 49/118
2002/0194784 A1 * 12/2002 Stojc ..... E05B 47/0012 49/118
2012/0011778 A1 * 1/2012 Kong ..... E05B 81/00 49/503
2012/0073208 A1 * 3/2012 Lee ..... E05F 15/652 49/449
2014/0090301 A1 * 4/2014 Takahashi ..... E05F 15/643 49/360
2016/0229424 A1 * 8/2016 Takayama ..... E05D 15/063
2019/0176856 A1 * 6/2019 Stojc ..... B61D 19/005

* cited by examiner

DOUBLE SLIDING-PLUG DOOR SYSTEM

TECHNICAL FIELD

The present invention relates to the field of doors, and more particularly, to a double sliding-plug door system.

BACKGROUND

A double sliding-plug door system used currently, which is generally a motor-driven screw stem, drives a nut assembly disposed on the screw stem to reciprocate, thereby driving a door leaf connected with the nut assembly. Generally speaking, the double sliding-plug door system is mostly applied to the field of public transportation vehicle doors like rail transit, and buses, and also has locking and unlocking functions. The double sliding-plug door system, which is generally applied to the above-mentioned fields, locks the nut assembly by an electromagnetic lock, thereby realizing the function of locking the door. For this type of double sliding-plug door system, the electromagnetic lock must be energized at any time to ensure the door locking stability. If the electromagnetic lock is de-energized, there is a risk when the door is automatically unlocked. However, most of the structures of locking the door by a mechanical lock in the prior art have the problem of complicated structures. As a system mainly composed of mechanical structures, complicated structures will bring problems such as poor reliability, big dead weight, and difficulty in control, and will threaten the personal safe of passengers especially when being applied to public transportation.

SUMMARY

Object of the present invention: the present invention provides a double sliding-plug door system to solve the problem that the door in the door system using the electromagnetic lock in the prior art is automatically unlocked after being de-energized, and the problems that the door system using the mechanical lock has complicated structure, big dead weight, and difficulty in control.

Technical solutions: in order to solve the foregoing technical problems, the double sliding-plug door system of the present invention comprises a fixed frame, a sliding-plug rail arranged in the fixed frame (40), a cross beam (11), a driving mechanism arranged in the cross beam for driving one side door to reciprocate, and a linkage mechanism matched with the driving mechanism for pulling another side door to reciprocate; and further comprises a guide locking piece arranged in the cross beam and a limiting mechanism. The driving mechanism comprises a screw rod and a nut assembly driven by a motor; the nut assembly comprises a transmission frame, a nut sleeved in the screw rod, and a follow-up member fixed in the nut; the nut is mounted in the transmission frame, and the transmission frame is connected with an active sleeve assembly; the screw rod drives the nut assembly to reciprocate axially along the screw rod; during the forward rotation of the screw rod, when the follow-up member is contacted with the guide locking piece, the follow-up member moves to the limiting mechanism under the guiding of an upper surface of the guide locking piece and is blocked by the limiting mechanism, then the follow-up member rotates with the screw rod to enter a space between a side plane of the guide locking piece and the limiting mechanism and is locked; and when the screw rod rotates reversely, the follow-up member reversely rotates with the screw rod to disengage from the limitation of the guide locking piece and is unlocked, and then moves axially along the screw rod.

Further, the transmission frame has a mechanism for defining a range of angles at which the nut rotates with the screw rod.

Further, the transmission frame has a mounting portion connected with the active sleeve assembly, the mounting portion extends upwards to form a nut mounting portion composed of four uprights, the nut is mounted in a space formed by the four uprights, and a limiting pin for defining a range of angles at which the nut rotates with the screw rod is mounted in top ends of the two uprights in a side facing the cross beam.

Further, an outer diameter of the nut is greater than a distance between the uprights at two sides, so the nut is confined in the space between the two uprights. When the nut moves axially along the screw rod, the transmission frame is driven to move together with the nut by applying a thrust to the uprights on different sides.

Further, the nut is composed of an inner ring and an outer ring, the inner ring is threadedly matched with the screw rod, and the outer ring sleeve is sleeved in the inner ring and is matched with the inner ring through an anti-slip gear, and one side of the outer ring facing the cross beam is outwards extended with a mounting base of the follow-up member.

Further, the mounting base has a screw hole, the follow-up member has a screw stem, and the screw stem is screwed into the screw hole to fixedly connect the follow-up member with the nut.

Further, the follow-up member is a roller, and the roller is matched with the guide locking piece to minimize a running resistance of the nut assembly when passing through a surface of the guide locking piece, and improve the system stability.

Further, the two sides of the outer ring of the nut are respectively located between the corresponding adjacent uprights, and the screw rod drives the transmission frame to rotate axially along the screw rod through the outer ring of the nut.

Further, the nut assembly further comprises an elastic member that applies a torsional force to the nut.

Further, the elastic member is a torsion spring, one end of the torsion spring rests on the transmission frame, and the other end of the torsion spring rests on the nut. The torsion spring adopts a model with an inner diameter larger than the diameter of the screw rod and is sleeved outside the screw rod.

Further, the outer ring of the nut is outwards extended with a stopper, and one end of the torsion spring rests on the stopper.

Further, the guide locking piece has a smooth upper surface that guides the follow-up member to move towards a limiting plate.

Further, the guide locking piece has a side plane facing the limiting plate, and a space enabling the follow-up member to fall into is formed between the side plane and the limiting mechanism.

Further, the side plane is an inclined plane that can restrict the follow-up member to pop up.

Further, an included angle between the side plane and a vertical plane is 0 to 10 degrees. In this angle range, the guide locking piece can apply an acting force to the follow-up member without causing the problem of locking the follow-up member due to excessive angle. The angle is 3 degrees preferably.

Further, a slide rail for moving the follow-up member is further provided, the slide rail is connected with the guide locking piece and is in smooth transition with the upper surface of the guide locking piece. The slide rail is arranged to move the follow-up member under the restriction of the slide rail, which can further increase the movement stationarity of the nut assembly.

Further, the limiting mechanism comprises a limiting plate mounted in the cross beam, the limiting plate has a side plane facing the guide locking piece, the side plane and the side plane of the guide locking piece constitute a space enabling the follow-up member to fall into.

Further, the limiting plate is rotatably mounted in the cross beam by a pin shaft, and one side of the limiting plate facing the guide locking piece has a bent vertical plate; and a return spring is arranged between the limiting plate and the pin shaft.

Further, the limiting plate is capable of triggering a signal switch during a rotating motion.

Further, the limiting plate is provided with a waist-shaped hole, a limiting pin is mounted in the cross beam, and the limiting pin extends into the waist-shaped hole to limit angle of rotation of the limiting plate.

Further, the fixed frame is further provided with a guide limiting rod, one end of the guide limiting rod is fixedly connected with the fixed frame, and the other end of the guide limiting rod is a free end; the limiting plate is rotatably mounted in the cross beam, when two side doors are locked by the driving mechanism and the linkage mechanism, the limiting plate rotates until the free end of the guide limiting rod is blocked, so as to limit the pulled side door to move back; when the two side doors are unlocked by the driving mechanism and the linkage mechanism, the limiting plate reversely rotates to release the blocking of the free end of the guide limiting rod, so that the pulled side door moves back; after the limiting plate rotates reversely to release the blocking of the free end of the guide limiting rod, the guide limiting rod approaches an edge of the limiting plate to limit the rotation of the limiting plate.

Further, the limiting mechanism comprises a manual mechanism that comprises a fixed bracket mounted in the cross beam and a movable bracket mounted in the pin shaft, a return spring is mounted between the two brackets, and the movable bracket is driven to rotate around the pin shaft by a manual pulling rope, and can pull the follow-up member out from the space between the guide locking piece and the limiting plate during rotation.

Further, the movable bracket and the limiting plate are mounted in the same pin shaft. The two do not interfere with each other, and have a high integration degree, which can save the mounting space.

Further, the driving mechanism is connected with the active sleeve assembly, the active sleeve assembly pulls a driven sleeve assembly through the linkage mechanism, and the active sleeve assembly and the driven sleeve assembly are respectively connected with the two side doors through a portal frame; the driven sleeve assembly is provided with a roller matched with the sliding-plug rail; and the two ends of the cross beam are provided with hanging racks, two long guide posts are arranged in parallel between the hanging racks, the active sleeve assembly and the driven sleeve assembly are respectively arranged on different long guide posts, and can reciprocate on the corresponding long guide posts respectively.

Further, the two ends of each long guide post pass through the hanging racks, and a rolling member is arranged at an end portion of the hanging rack, a set of mounting brackets are arranged in the fixed frame, and the rolling member is matched with a slideway arranged inside the mounting brackets.

Further, a synchronization rod is arranged between the mounting brackets, and the two ends of the synchronization rod are fixedly connected with linkage arms, and each linkage arm is movably connected with the hanging rack through a connecting rod.

Further, the linkage mechanism comprise rollers respectively arranged in each of the hanging racks and a pulling member arranged in the rollers, the pulling member forms a closed loop between the two rollers, one side of the closed-loop pulling member is connected with the active sleeve assembly and the other side of the pulling member is connected with the driven sleeve assembly.

Beneficial effects: according to the double sliding-plug door system of the present invention, the combination of the nut assembly with the guide locking piece and the limiting mechanism solves the problem of safety risk caused by the automatic unlocking of the double sliding-plug door system in the prior art when the existing electromagnetic lock fails, and is also simpler and more reliable than the existing mechanical lock structure, and the nut assembly is simpler in structure and more stable in operation than the form of being matched with a runner in the prior art. Since the number of members constituting the screw-driven control system is small, the screw-driven control system is easy to machine and has a small dead weight, and does need too much mounting space.

DETAILED DESCRIPTION

Figure 1:
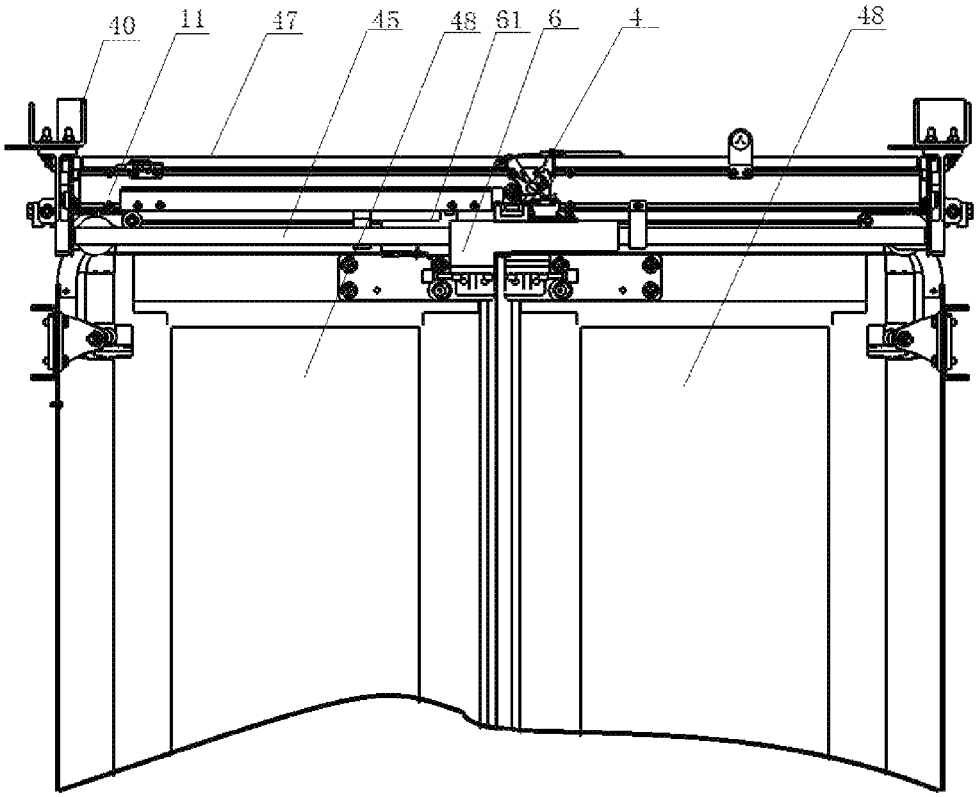
FIG. 1 is a schematic diagram of an overall structure of the present invention.
Figure 2:
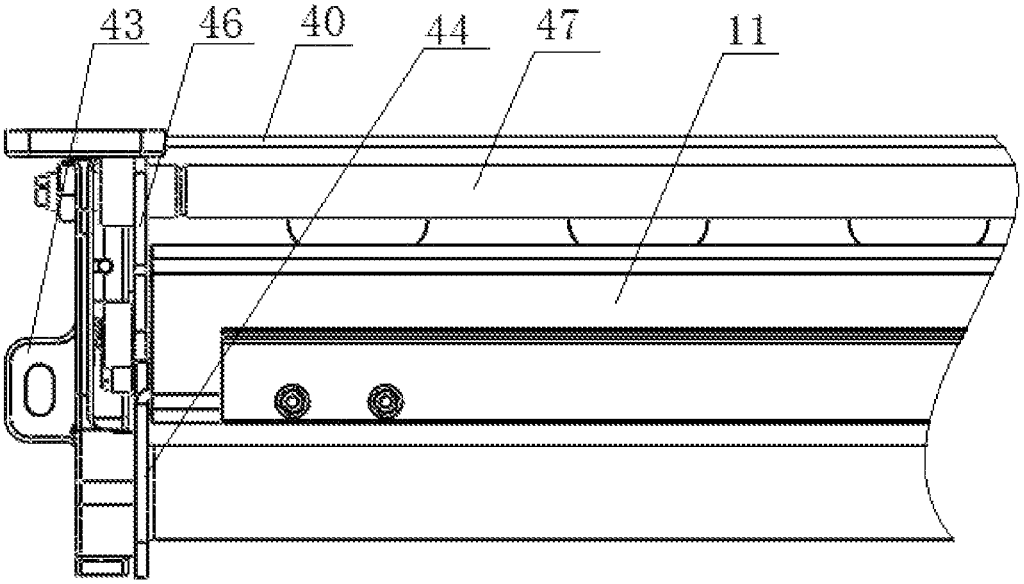
FIG. 2 is a partial schematic diagram showing a combined state of a fixed frame and a cross beam.
Figure 3:
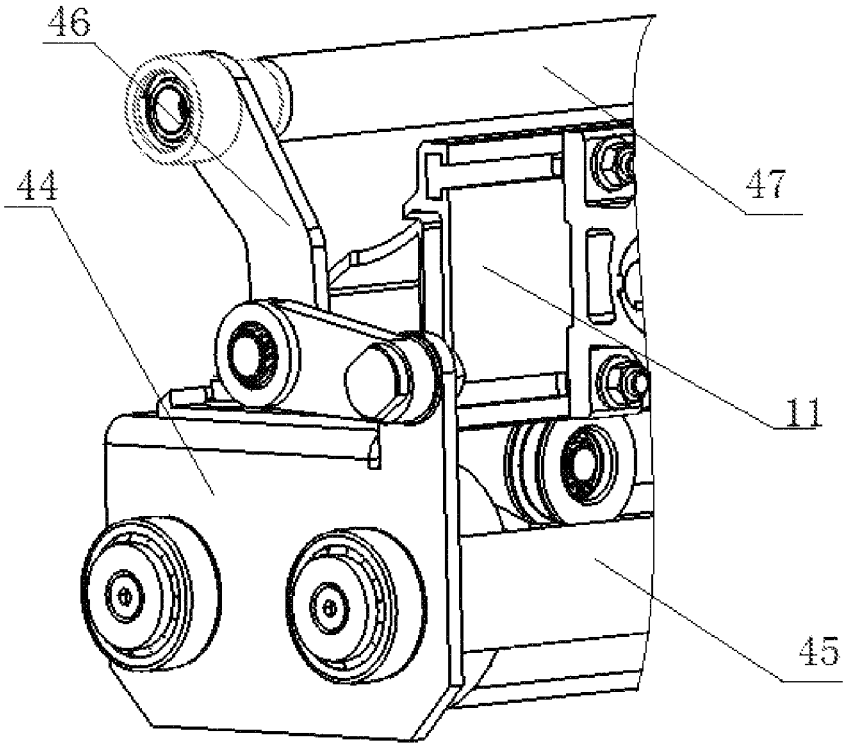
FIG. 3 is a partial schematic diagram showing a mounting bracket hidden in a left end portion of FIG. 2.
Figure 4:
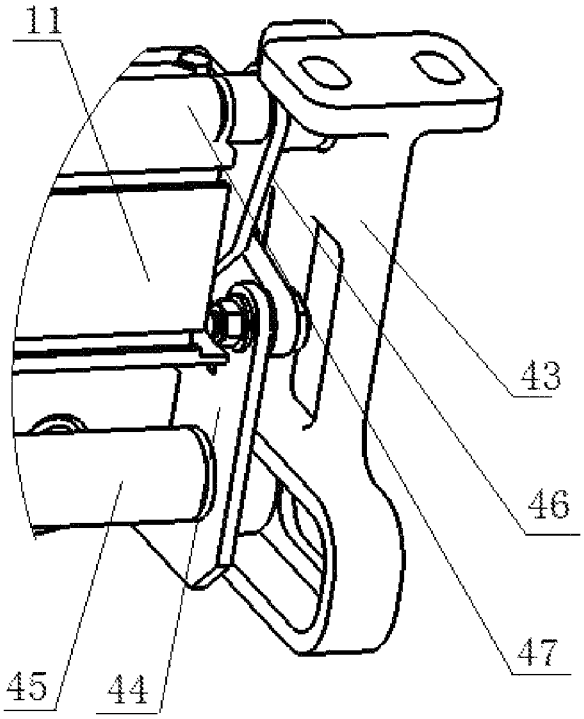
FIG. 4 is a partial schematic diagram showing a combined state of a cross beam, a mounting bracket, a hanging rack, a long guide post, and a synchronizing rod.

The invention is further explained with reference to the drawings hereinafter.

A double sliding-plug door system as shown in FIG. 1 to FIG. 15 comprises a fixed frame 40, a sliding-plug rail 41 arranged in the fixed frame 40, a cross beam 11, a driving mechanism arranged in the cross beam 11 for driving one side door to reciprocate, and a linkage mechanism matched with the driving mechanism for pulling another side door to reciprocate. The driving mechanism is connected with the active sleeve assembly 6, the active sleeve assembly 6 pulls the driven sleeve assembly 61 through the linkage mechanism, and the linkage mechanism drives a door 48 that drives the active sleeve assembly 6 to move opposite or relative to a door 48 of the driven sleeve assembly 61. The active sleeve assembly 6 and the driven sleeve assembly 61 are respectively connected with the two side doors 48 through a portal frame. The driven sleeve assembly 61 is also provided with a roller matched with the sliding-plug rail 41; The two ends of the cross beam 11 are respectively provided with hanging racks 49, two long guide posts 50 are arranged in parallel between the hanging racks 49, the active sleeve assembly 6 and the driven sleeve assembly 61 are respectively arranged on different long guide posts 50, and can reciprocate on the corresponding long guide posts 50 respectively. The two ends of each long guide post 50 pass through the hanging racks 49, and a rolling member is arranged at an end portion of the hanging rack, the rolling member is an apparatus or part having a rolling function like a bearing, a set of mounting brackets 43 are arranged in the fixed frame 40, and the rolling member is matched with a slideway arranged inside the mounting brackets 43. A synchronization rod 47 may also be arranged between the mounting brackets 43, and the two ends of the synchronization rod 47 are fixedly connected with linkage arms 64, and each linkage arm 64 is movably connected with the hanging rack 49 through a connecting rod. As shown in FIG. 15, the linkage mechanism comprises rollers respectively arranged in each of the hanging racks 49 and a pulling member 63 arranged in the rollers, the pulling member 63 forms a closed loop between the two rollers, one side of the closed-loop pulling member 63 is connected with the active sleeve assembly 6 and the other side of the pulling member is connected with the driven sleeve assembly 61, while the pulling member 63 may be a synchronous belt, a wire rope, a transmission chain, or the like. When the transmission chain is used, the roller can be replaced by a gear.

As shown in FIG. 7 to FIG. 14, the driving mechanism comprises a motor 1 fixed in the cross beam 11, a guide locking piece 51 and a limiting mechanism 4. The motor 1 is connected with a controller; a shaft of the motor 1 is connected with a screw rod 2, and the screw rod 2 is configured with a nut assembly 3 in set; the nut assembly 3 comprises a nut 31 and a follow-up member 7 rigidly connected with the nut 31, the nut 31 and the screw rod 2 constitute a screw motion pair, a transmission frame 9 is mounted outside the nut 31, and the transmission frame 9 and the nut 31 can move relatively. A torsion spring 10 is arranged between the transmission frame 9 and the nut 31, the torsion spring 10 applies a pressure to the follow-up member 7 with the transmission frame 9 as a support, and the transmission frame 9 is connected with an active sleeve assembly 6. During the forward rotation of the screw rod 2, the nut 31 is driven to move together with the follow-up member 7; when the nut moves to a position that the follow-up member 7 is contacted with the guide locking piece 51, the follow-up member 7 moves to the limiting mechanism 4 under the guiding of an upper surface of the guide locking piece 51 and is blocked by the limiting mechanism 4, then the follow-up member 7 rotates with the screw rod 2 to enter a space between a side of the guide locking piece 51 and the limiting mechanism 4 and is locked. When the screw rod 2 rotates reversely, the follow-up member 7 reversely rotates with the screw rod 2 to disengage from the limitation of the guide locking piece 51 and is unlocked, and then moves axially along the screw rod 2. The guide locking piece 51 has a side plane facing the limiting mechanism 4, and a space enabling the follow-up member 7 to fall into is formed between the side plane and the limiting mechanism 4. The side plane is an inclined plane that can restrict the follow-up member 7 to pop up. An included angle between the side plane and a vertical plane is 0 to 10 degrees. In this angle range, the guide locking piece 51 can apply an acting force to the follow-up member 7 without causing the problem of locking the follow-up member 7 due to excessive angle. The angle is 3 degrees preferably. The transmission frame 9 also has a mechanism for defining a range of angles at which the nut 31 rotates with the screw rod 2. The mechanism is a space, and the follow-up member 7 on the nut 31 moves up and down with the nut 31 in the space, and an upper end and a lower end of the space define a range of rotation of the follow-up member 7, which in turn defines a range of rotation of the nut 31 as moving with the screw rod 2.

Figure 7:
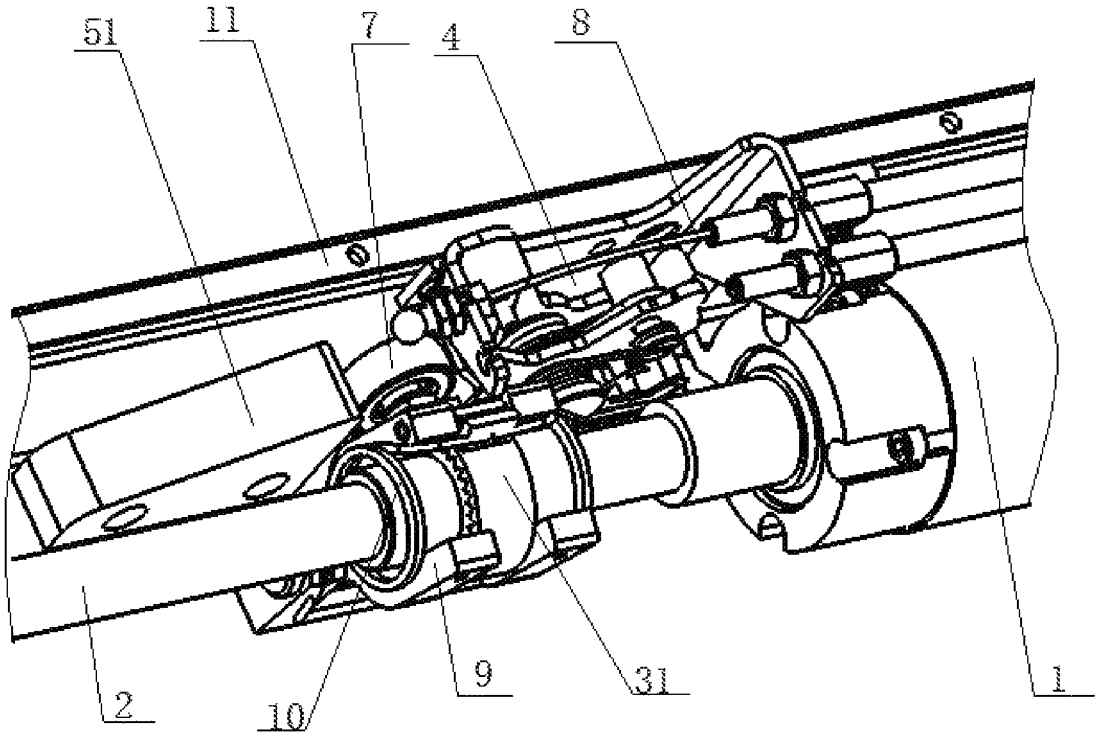
FIG. 7 is a first implementation manner of a guide locking piece.

As shown in FIG. 7, as a first embodiment, the guide locking piece 51 has a smooth upper surface that guides the follow-up member 7 to move towards the limiting mechanism 4, and during the movement of the follow-up member 7, when the follow-up member 7 is not contacted with the upper surface of the guide locking piece 51, the follow-up member 7 is in a free state, i.e., at the lower end of the above space defining the rotation of the follow-up member 7, the torsion spring 10 arranged between the nut 31 and the transmission frame 9 can be set in a relaxed state or small compressed state without applying a torsional force to the nut 31, or applying a small torsional force to the nut 31, so that the nut 31 can be more stable in driving the follow-up member 7 to operate. When the follow-up member 7 passes the upper surface of the guide locking piece 51, the torsion spring 10 is compressed to apply a torsional force to the nut 31, thereby ensuring that the follow-up member 7 can smoothly enter the space between a limiting plate 13 and the guide locking piece 51 after contacting the limiting plate 13 by driving the nut 31 via the rotation of the screw rod 2 and through the torsional force applied by the torsion spring 10.

Figure 8:
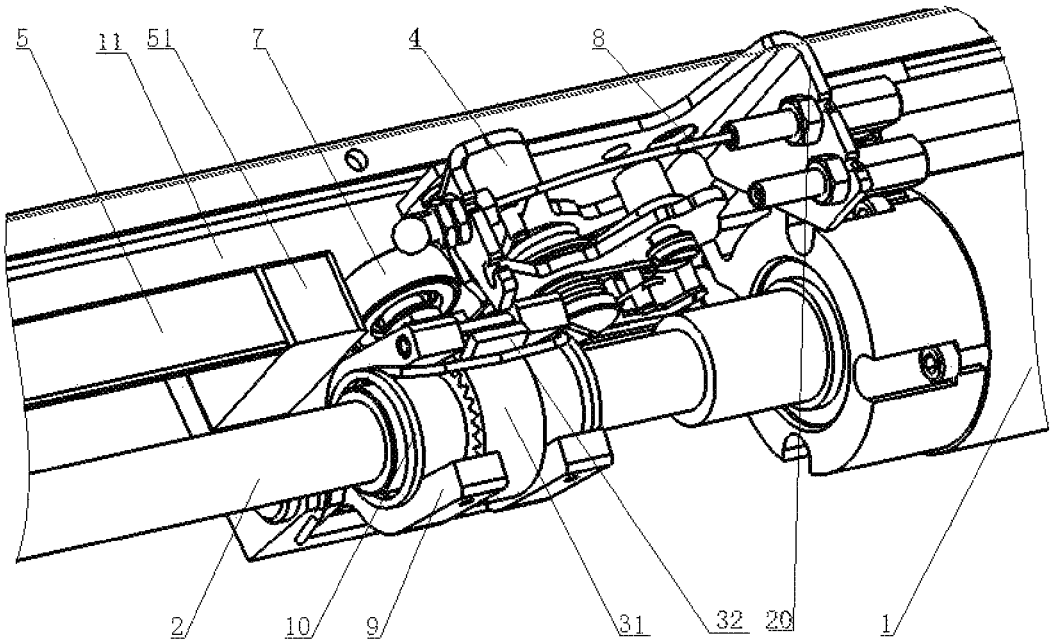
FIG. 8 is a second implementation manner of the guide locking piece.
Figure 9:
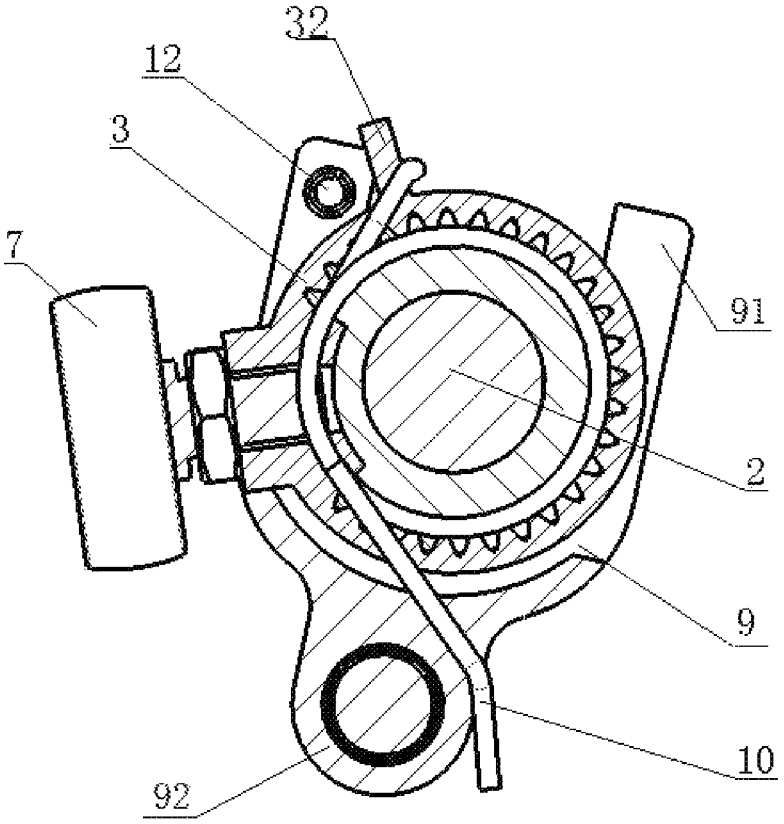
FIG. 9 is a structural schematic diagram of a nut assembly.
Figure 10:
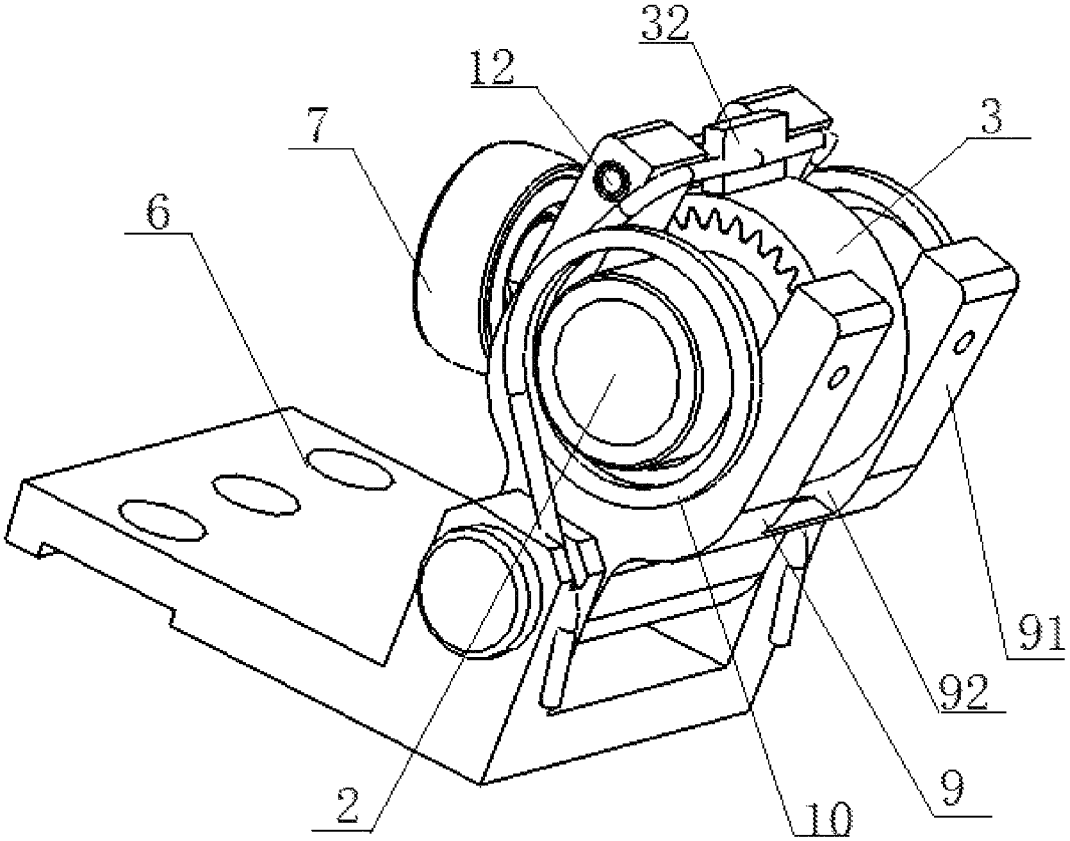
FIG. 10 is a schematic diagram showing a combined structure of a nut assembly and a transmission frame.
Figure 11:
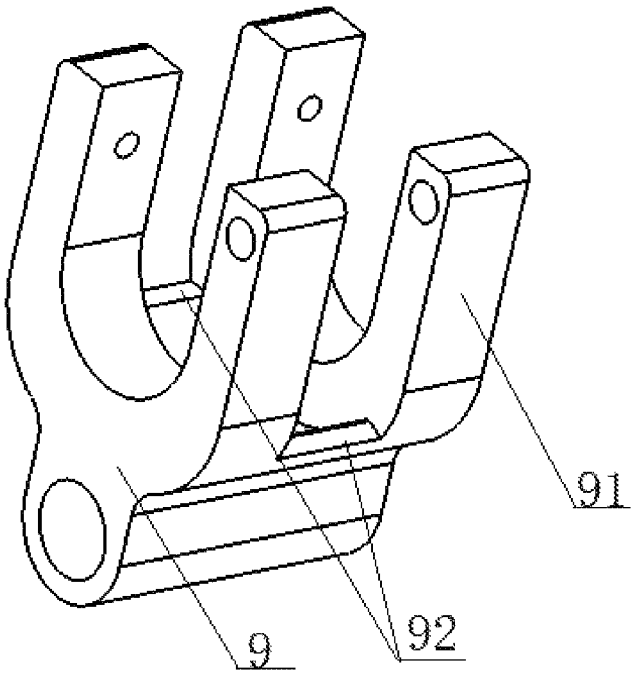
FIG. 11 is a structural schematic diagram of a transmission frame.
Figure 12:
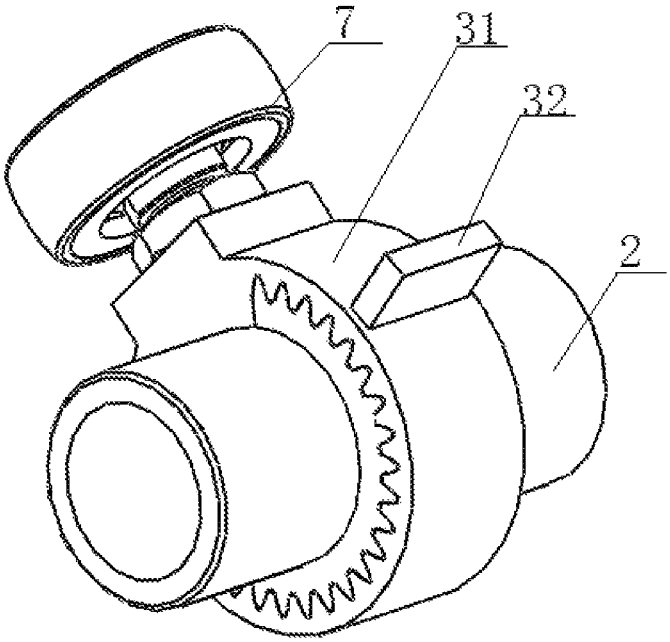
FIG. 12 is a structural schematic diagram of a nut.

As shown in FIG. 8, as a second embodiment, a slide rail 5 for moving the follow-up member 7 is fixedly mounted in the cross beam 11, the slide rail 5 is connected with the guide locking piece 51 and is in smooth transition with the upper surface of the guide locking piece 51. Specifically, the guide locking piece 51 is arranged at one end of the slide rail 5 near a limiting member, and has a horizontal upper surface that is jointed with an upper surface of the slide rail 5 to form an integral horizontal surface. After the slide rail 5 is arranged, the follow-up member 7 is contacted with the upper surface of the guide locking piece 51, and can reciprocate on the upper surface. Under such arrangement, the follow-up member 7 is located between the upper end and the lower end of the above space defining the rotation of the follow-up member 7, and is not contacted with the upper end or the lower end. At this moment, the torsion spring 10 arranged between the nut 31 and the transmission frame 9 is in a compressed state; when the follow-up member 7 moves to contact with the limiting plate 13, a rotating force of the screw rod 2 to drive the nut 31 by rotation and the torsional force applied by the torsion spring 10 to the nut 31 ensure that the follow-up member 7 can smoothly enter the space between the limiting plate 13 and guide locking piece 51. The slide rail 5 is arranged to move the follow-up member 7 under the restriction of the slide rail 5, which can further increase the movement stationarity of the nut assembly 3.

As shown in FIG. 9 to FIG. 12, the transmission frame 9 has a mounting portion 91 connected with the active sleeve assembly 6, and the mounting portion 91 extends upwards to form a nut mounting portion composed of four uprights 92. The nut 31 is mounted in a space formed by the four uprights 92, and a limiting pin 12 for defining a range of angles at which the nut 31 rotates with the screw rod 2 is mounted in top ends of the two uprights 92 in a side facing the cross beam 11. Therefore, a rotation space of the nut 31 as the screw rod 2 rotates is formed between the limiting pin 12 and the bottom of the two uprights 92 at the side of the cross beam 11. The limiting pin 12 is the above-mentioned upper end, and the bottom of the space between the two uprights 92 is the lower end. An outer diameter of the nut 31 is greater than a distance between the uprights 92 at the two sides, so that the nut 31 is limited in the space between the uprights 92 at the two sides, and when the nut 31 moves axially along the screw rod 2, the transmission frame 9 is driven to rotate together with the nut 31 through applying a thrust to the uprights 92 at different sides. The nut 31 is composed of an inner ring and an outer ring, the inner ring is threadedly matched with the screw rod 2, the outer ring is sleeved in the inner ring and is matched with the inner ring through an anti-slip gear, and one side of the outer ring facing the cross beam 11 is outwards extended with a mounting base of the follow-up member 7. The mounting base has a screw hole, the follow-up member 7 has a screw stem, and the screw stem is screwed into the screw hole to fixedly connect the follow-up member 7 with the nut 31. The follow-up member 7 may be a roller or other type of member having a smooth surface and small running resistance, such as a sliding block having a smooth surface, etc. The roller matched with the guide locking piece 51 can minimize a running resistance of the nut assembly 3 when passing through the surface of the guide locking piece 51, and improve the system stability. The two sides of the outer ring of the nut 31 are respectively located between the corresponding adjacent uprights 92, and the screw rod 2 drives the transmission frame 9 to rotate axially along the screw rod 2 through the outer ring of the nut 31. The nut assembly 3 further comprises a torsion spring 10 that applies a torsional force to the nut 31. One end of the torsion spring rests on the transmission frame 9, and the other end of the torsion spring rests on the nut 31. The torsion spring adopts a model with an inner diameter larger than the diameter of the screw rod 2 and is sleeved outside the screw rod 2. The outer ring of the nut 31 is outwards extended with a stopper 32, and one end of the torsion spring rests on the stopper 32.

Figure 13:
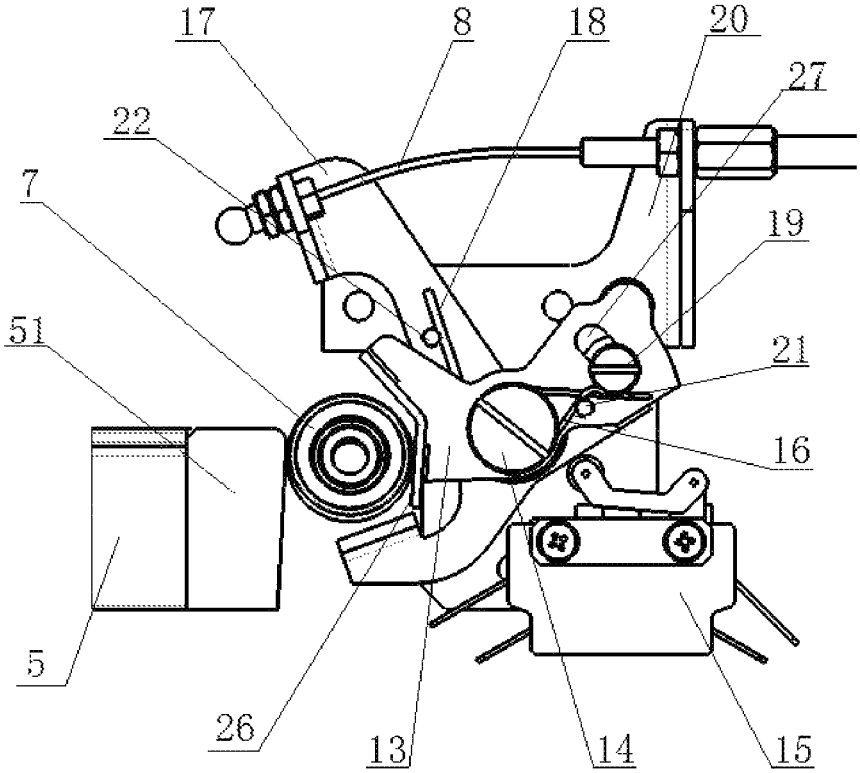
FIG. 13 is a schematic diagram showing a match state of a guide locking piece with a limiting mechanism and a follow-up member.

As shown in FIG. 13, the limiting mechanism 4 comprises a limiting plate 13 mounted in the cross beam 11, the limiting plate 13 has a side plane facing the guide locking piece 51, the side plane and a side plane of the guide locking piece 51 form a space enabling the follow-up member 7 to fall into, the limiting plate 13 is rotatably mounted in the cross beam 11 via a pin shaft 14, one side of the limiting plate 13 facing the guide locking piece 51 has a bent vertical plate 26, and an angle of the vertical plate 26 is correspondingly set according to practical application. Specifically, when the follow-up member 7 is not contacted with the vertical plate 26, an upper half of the bent vertical plate 26 is vertical, and a lower half of the bent vertical plate is bent towards the guide locking piece 51. However, when the follow-up member 7 is contacted with the vertical plate 26, the limiting plate 13 is driven to rotate. When the rotation stops, the lower half becomes the vertical, while the upper half is bent towards the guide locking piece 51, and a bending degree of the vertical plate 26 is determined according to a rotation angle of the limiting plate 13. If the rotation angle of the limiting plate 13 is $\alpha$, then tan obtuse angle between the upper half and the lower half of the vertical plate 26 is $180-\alpha$. A return spring is further arranged between the limiting plate 13 and the pin shaft 14. The return spring may be a torsion spring. The torsion spring is sleeved in the pin shaft 14. One end of the torsion spring is fixed in the limiting plate 13 and the other end of the torsion spring is fixed in the cross beam 11. The limiting plate 13 can trigger a signal switch 15 through an edge thereof during a rotating action, the limiting plate 13 is provided with a waist-shaped hole 27, a limiting pin 19 is mounted in the cross beam 11, and the limiting pin 19 extends into the waist-shaped hole 27 to limit the angle of rotation of the limiting plate 13.

Figure 5:
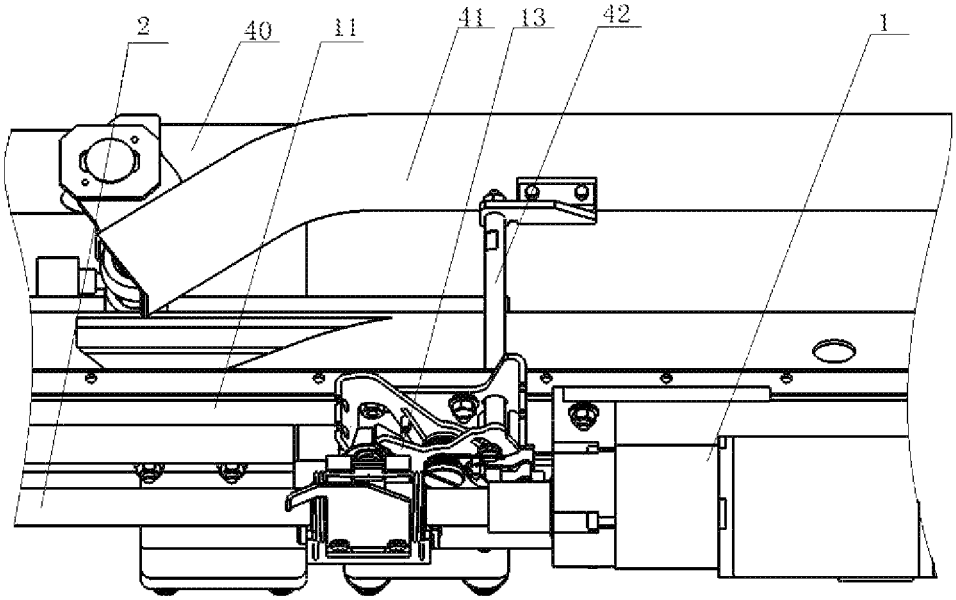
FIG. 5 is a schematic diagram showing a position between a guide limiting rod and a limiting plate in a locked state of a door.
Figure 6:
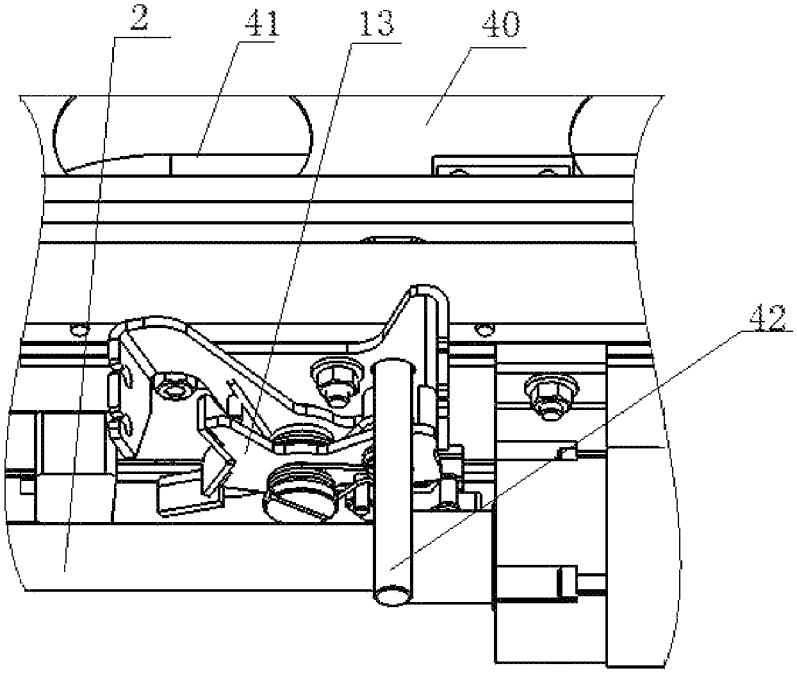
FIG. 6 is a schematic diagram showing a position between the guide limiting rod and the limiting plate in an unlocked state of the door.

As shown in FIG. 5 and FIG. 6, the fixed frame 40 is further provided with a guide limiting rod 42, one end of the guide limiting rod is fixedly connected with the fixed frame 40, and the other end of the guide limiting rod is a free end; the limiting plate 13 is rotatably mounted in the cross beam 11, when two side doors 48 are locked by the driving mechanism and the linkage mechanism, the limiting plate 13 rotates until the free end of the guide limiting rod 42 is blocked, so as to limit the pulled side door to move back; when the two sides doors 48 are unlocked by the driving mechanism and the linkage mechanism, the limiting plate 13 reversely rotates to release the blocking of the free end of the guide limiting rod 42, so that the pulled side door moves back; after the limiting plate 13 rotates reversely to release the blocking of the free end of the guide limiting rod 42, the guide limiting rod 42 approaches an edge of the limiting plate 13 to limit the rotation of the limiting plate 13.

Figure 14:
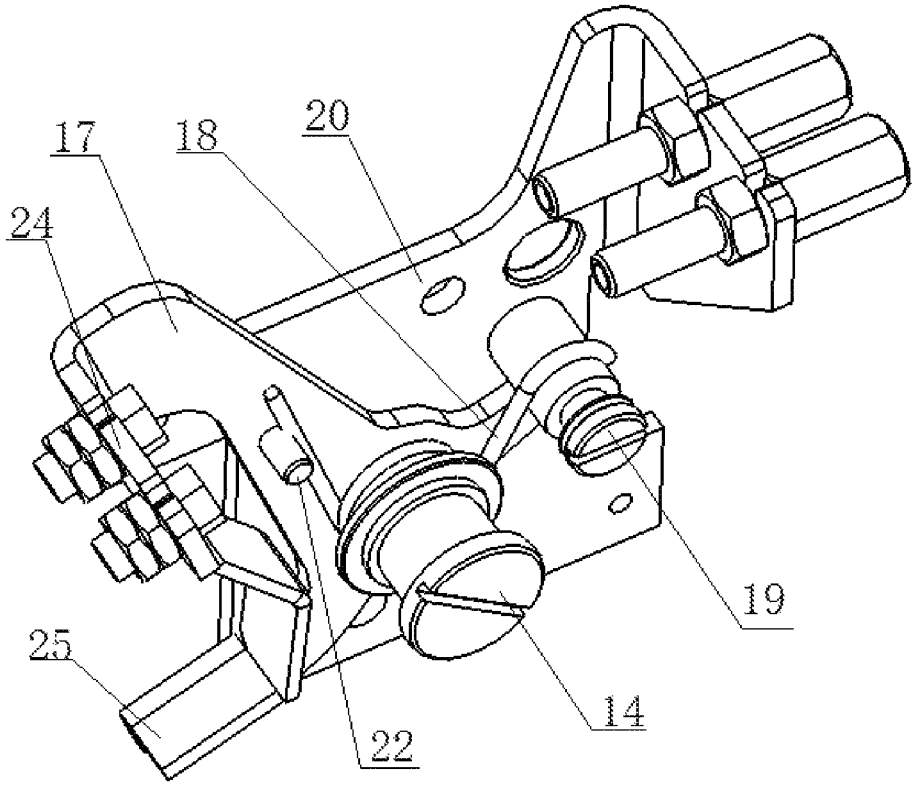
FIG. 14 is a structural schematic diagram of a manual mechanism.
Figure 15:
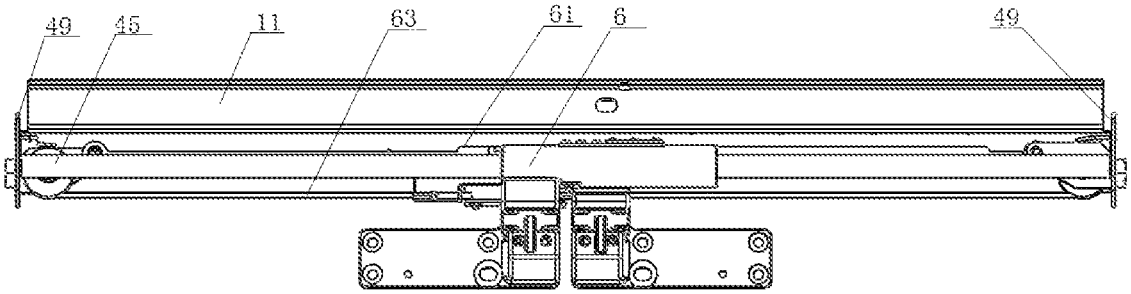
FIG. 15 is a structural schematic diagram of a cross beam comprising a linkage mechanism.

As shown in FIG. 13 and FIG. 14, the limiting mechanism 4 further comprises a manual mechanism that comprises a fixed bracket 20 mounted in the cross beam 11 and a movable bracket 17 mounted in the pin shaft 14, a return spring is mounted between the two brackets, the return spring may be a torsion spring, the torsion spring is sleeved in the pin shaft 14, one end of the torsion spring is fixed in the fixed bracket 20, and the other end of the torsion spring is fixedly connected with the movable bracket 17. The movable bracket 17 can pull the follow-up member 7 out from the space between the guide locking piece 51 and the limiting mechanism 4 during rotation. Specifically, a bent poking block 21 can be arranged at a lower portion of the movable bracket 17, and the poking block 21 pulls the follow-up member 7 out from the space between the guide locking piece 51 and the limiting mechanism 4 from the lower side of the follow-up member 7. The movable bracket 17 can be driven to rotate around the pin shaft 14 by a manual pulling rope 8. The manual pulling rope is connected with an unlocking switch. The unlocking switch can be a manual knob which can pull the manual pulling rope 8 while rotating. During practical applications, the unlocking switch is actually mounted in a position such as an inner wall of a subway that is easily accessible to people. When the unlocking switch is rotated to drive the movable bracket 17 to rotate with the pin shaft 14 as a center of rotation, the poking block 21 pushes the follow-up member 7 upwards. The movable bracket 17 and the limiting plate 13 are mounted in the same pin shaft 14. The two do not interfere with each other, and have a high integration degree, which can save the mounting space.

The double sliding-plug door system of the present invention can be divided into the following motion processes and states:

1. Electrically locking the door: the controller sends a signal to the motor 1 to cause the motor 1 to drive the screw rod 2 to rotate, and the screw rod 2 drives the follow-up member 7 to move axially along the screw rod 2 to the limiting mechanism 4 through the nut assembly 3; when the follow-up member 7 is contacted with the guide locking piece 51, the follow-up member moves to the limiting plate 13 under the guiding of the upper surface of the guide locking piece 51 and is blocked by the limiting plate 13. The follow-up member 7 rotates with the screw rod 2 into the space between the side plane of the guide locking piece 51 and the limiting plate 13 and is locked. In the process, the limiting plate 13 rotates to trigger the signal switch 15 arranged under the limiting plate. After the signal switch 15 sends an in-position signal to the controller, the controller controls the motor 1 to stop rotating and complete locking the door. At this moment, the limiting plate 13 is blocked at the front of the free end of the guide limiting rod 42. When the linkage mechanism fails, since the door of the active sleeve assembly 6 has been locked by the guide locking piece, the door will not be easily unlocked. If there is no guide limiting rod 42, the door on the side of the driven sleeve assembly 61 can be manually unlocked and the entire beam can be driven to perform a sliding-plug action. The sliding-plug action is blocked since the guide limiting rod 42 is arranged; therefore, one side door of the driven sleeve assembly 61 cannot be unlocked even if it is manually pulled.

2. Electrically unlocking the door: the controller sends a signal to the motor 1 to cause the motor 1 to drive the screw rod 2 to rotate reversely, and the follow-up member 7 reversely rotates with the screw rod 2 to disengage from the limitation of the guide locking piece 51 and is unlocked, and disengaged from the limiting plate 13. The limiting plate 13 is returned under the action of the torsion spring to release the blocking on the guide limiting rod 42 and trigger the signal switch 15 to send an unlocking signal to the controller, then the limiting member moves axially along the screw rod 2. When the follow-up member 7 moves to the other end of the screw rod 2, the motor 1 stops running and the door is unlocked. At this moment, the guide limiting rod 42 is above the limiting plate 13 and can limit the reverse rotation of the limiting plate 13 to avoid accidentally triggering the signal switch.

3. Manually locking the door: the active sleeve assembly 6 is manually driven to move the nut assembly 3 axially from the screw rod 2 to the limiting mechanism 4. At this moment, the screw rod 2 rotates passively. When the follow-up member 7 is contacted with the guide locking piece 51, the follow-up member moves to the limiting plate 13 under the guiding of the upper surface of the guide locking piece 51 and is blocked by the limiting plate 13. The follow-up member 7 rotates with the screw rod 2 into the space between the side plane of the guide locking piece 51 and the limiting plate 13 and is locked. During this process, the limiting plate 13 rotates to trigger the signal switch 15 arranged under the limiting plate. After the signal switch 15 sends an in-position signal to the controller, the controller controls the motor 1 to stop running and complete locking the door.

4. Manually unlocking the door: when the two side doors are in a locked state, by rotating the unlocking switch, the manual pulling rope 8 pulls the movable bracket 17 to rotate clockwise around the pin shaft 14, and the poking block 21 of the movable bracket 17 pokes the follow-up member 7 from the lower portion to make the follow-up member 7 leave the locking position, and meanwhile, the torsion spring drives limiting plate 13 to rotate clockwise around the pin shaft 14 and triggers the signal switch 15. After the unlocking switch is released, the movable bracket 17 is driven by the return spring to rotate to the initial position, and then the active sleeve assembly 6 is manually driven to move the nut assembly 3 axially from the screw shaft 2 towards a direction away from the limiting mechanism 4 to realize manual unlocking the door.

The descriptions above are merely preferable embodiments of the invention, and it should be noted that those of ordinary skills in the art may make a plurality of improvements and decorations without departing from the principle of the invention, and these improvements and decorations shall also fall within the protection scope of the invention.

The invention claimed is:

1. A double sliding-plug door system, comprising a fixed frame, a sliding-plug rail arranged in the fixed frame, a cross beam, a driving mechanism arranged in the cross beam for driving a side door to reciprocate, and a linkage mechanism matched with the driving mechanism for pulling another side door to reciprocate; and, further comprising a guide locking piece arranged in the cross beam, and a limiting mechanism; wherein, the driving mechanism comprises a screw rod and a nut assembly driven by a motor; the nut assembly comprises a transmission frame, a nut sleeved in the screw rod, and a follow-up member fixed in the nut; the nut is mounted in the transmission frame, and the transmission frame is connected with an active sleeve assembly; the screw rod drives the nut assembly to reciprocate axially along the screw rod; during forward rotation of the screw rod, when the follow-up member is contacted with the guide locking piece, the follow-up member moves to the limiting mechanism under the guiding of an upper surface of the guide locking piece and is blocked by the limiting mechanism, then the follow-up member rotates with the screw rod to enter a space between a side plane of the guide locking piece and the limiting mechanism and is locked; and when the screw rod rotates reversely, the follow-up member reversely rotates with the screw rod to disengage from the limitation of the guide locking piece and is unlocked, and then moves axially along the screw rod.

2. The double sliding-plug door system according to claim 1, wherein the transmission frame has a mechanism for defining a range of angles at which the nut rotates with the screw rod.

3. The double sliding-plug door system according to claim 2, wherein the transmission frame has a mounting portion connected with a controlled object, the mounting portion extends upwards to form a nut mounting portion composed of four uprights, the nut is mounted in a space formed by the four uprights, and a limiting pin for defining a range of angles at which the nut rotates with the screw rod is mounted in top ends of the two uprights in a side facing the cross beam.

4. The double sliding-plug door system according to claim 3, wherein an outer diameter of the nut is greater than a distance between the uprights at two sides.

5. The double sliding-plug door system according to claim 3, wherein the nut is composed of an inner ring and an outer ring, the inner ring is threadedly matched with the screw rod, and the outer ring sleeve is sleeved in the inner ring and is matched with the inner ring through an anti-slip gear, and one side of the outer ring facing the cross beam is outwards extended with a mounting base of the follow-up member.

6. The double sliding-plug door system according to claim 5, wherein the mounting base has a screw hole, the follow-up member has a screw stem, and the screw stem is screwed into the screw hole to fixedly connect the follow-up member with the nut.

7. The double sliding-plug door system according to claim 5, wherein two sides of the outer ring of the nut are respectively located between corresponding adjacent uprights, and the screw rod drives the transmission frame to rotate axially along the screw rod through the outer ring of the nut.

8. The double sliding-plug door system according to claim 1, wherein the follow-up member is a roller.

9. The double sliding-plug door system according to claim 1, wherein the nut assembly further comprises an elastic member that applies a torsional force to the nut.

10. The double sliding-plug door system according to claim 9, wherein the elastic member is a torsion spring, one end of the torsion spring rests on the transmission frame, and another end of the torsion spring rests on the nut.

11. The double sliding-plug door system according to claim 10, wherein the outer ring of the nut is outwards extended with a stopper, and one end of the torsion spring rests on the stopper.

12. The double sliding-plug door system according to claim 1, wherein the guide locking piece has an upper surface that guides the follow-up member to move towards a limiting plate.

13. The double sliding-plug door system according to claim 1, wherein the guide locking piece has a side plane facing the limiting plate, and a space enabling the follow-up member to fall into is formed between the side plane and the limiting plate.

14. The double sliding-plug door system according to claim 13, wherein the side plane is an inclined plane that can restrict the follow-up member to pop up.

15. The double sliding-plug door system according to claim 14, wherein an included angle between the side plane and a vertical plane is 0 to 10 degrees.

16. The double sliding-plug door system according to claim 1, wherein a slide rail for moving the follow-up member is further provided, the slide rail is connected with the guide locking piece and is in smooth transition with the upper surface of the guide locking piece.

17. The double sliding-plug door system according to claim 1, wherein the limiting mechanism comprises a limiting plate mounted in the cross beam, the limiting plate has a side plane facing the guide locking piece, the side plane and the side plane of the guiding block constitute a space enabling the follow-up member to fall into.

18. The double sliding-plug door system according to claim 17, wherein the limiting plate is rotatably mounted in the cross beam by a pin shaft, and one side of the limiting plate facing the guide locking piece has a bent vertical plate; and a return spring is arranged between the limiting plate and the pin shaft.

19. The double sliding-plug door system according to claim 18, wherein the limiting plate is capable of triggering a signal switch during a rotating motion.

20. The double sliding-plug door system according to claim 18, wherein the limiting plate is provided with a waist-shaped hole, a limiting pin is mounted in the cross beam, and the limiting pin extends into the waist-shaped hole to limit angle of rotation of the limiting plate.

21. The double sliding-plug door system according to claim 17, wherein the fixed frame is further provided with a guide limiting rod, one end of the guide limiting rod is fixedly connected with the fixed frame, and another end of the guide limiting rod is a free end; the limiting plate is rotatably mounted in the cross beam, when two side doors are locked by the driving mechanism and the linkage mechanism, the limiting plate rotates until the free end of the guide limiting rod is blocked, so as to limit a pulled one of the side doors to move back, the side doors including said side door and said another side door; when the two side doors are unlocked by the driving mechanism and the linkage mechanism, the limiting plate reversely rotates to release the blocking of the free end of the guide limiting rod, so that the pulled one of the side doors moves back; after the limiting plate rotates reversely to release the blocking of the free end of the guide limiting rod, the guide limiting rod approaches an edge of the limiting plate to limit the rotation of the limiting plate.

22. The double sliding-plug door system according to claim 1, wherein the limiting mechanism comprises a manual mechanism that comprises a fixed bracket mounted in the cross beam and a movable bracket mounted in a pin shaft, a return spring is mounted between the two brackets, and the movable bracket is driven to rotate around the pin shaft by a manual pulling rope, and can pull the follow-up member out from the space between the guide locking piece and the limiting plate during rotation.

23. The double sliding-plug door system according to claim 22, wherein the movable bracket and the limiting plate are mounted in the pin shaft.

24. The double sliding-plug door system according to claim 1, wherein the driving mechanism is connected with the active sleeve assembly, the active sleeve assembly pulls a driven sleeve assembly through the linkage mechanism, and the active sleeve assembly and the driven sleeve assembly are respectively connected with two side doors through a portal frame; the driven sleeve assembly is provided with a roller matched with the sliding-plug rail; and the two ends of the cross beam are provided with hanging racks, two guide posts are arranged in parallel between the hanging racks, the active sleeve assembly and the driven sleeve assembly are respectively arranged on different ones of the guide posts, and can reciprocate on corresponding ones of the guide posts respectively.

25. The double sliding-plug door system according to claim 24, wherein the two ends of each long guide post pass through the hanging racks, and a rolling member is arranged at an end portion of the hanging rack, a set of mounting brackets are arranged in the fixed frame, and the rolling member is matched with a slideway arranged inside the mounting brackets.

26. The double sliding-plug door system according to claim 24, wherein a synchronization rod is arranged between the mounting brackets, and the two ends of the synchronization rod are fixedly connected with linkage arms, and each linkage arm is movably connected with the hanging rack through a connecting rod.

27. The double sliding-plug door system according to claim 24, wherein the linkage mechanism comprise rollers respectively arranged in each of the hanging racks and a pulling member arranged in the rollers, the pulling member forms a closed loop between the two rollers, one side of the closed-loop pulling member is connected with the active sleeve assembly and another side of the pulling member is connected with the driven sleeve assembly.

* * * * *